US007494190B2

(12) United States Patent
Kussel

(10) Patent No.: US 7,494,190 B2
(45) Date of Patent: Feb. 24, 2009

(54) COAL FACE SUPPORT IN A MINE

(75) Inventor: Willi Kussel, Werne (DE)

(73) Assignee: Tiefenbach Control Systems GmbH, Essen (DE)

( * ) Notice: Subject to any disclaimer, the term of this patent is extended or adjusted under 35 U.S.C. 154(b) by 360 days.

(21) Appl. No.: 10/538,817

(22) PCT Filed: Dec. 11, 2003

(86) PCT No.: PCT/DE03/04081

§ 371 (c)(1),
(2), (4) Date: Jun. 14, 2006

(87) PCT Pub. No.: WO2004/055328

PCT Pub. Date: Jul. 1, 2004

(65) Prior Publication Data

US 2006/0267395 A1 Nov. 30, 2006

(30) Foreign Application Priority Data

Dec. 17, 2002 (DE) ..... 102 59 214

(51) Int. Cl.
*E21D 23/08* (2006.01)

(52) U.S. Cl. ..... 299/1.7; 299/1.05

(58) Field of Classification Search ..... 299/1.05, 299/1.6, 1.7

See application file for complete search history.

(56) References Cited

U.S. PATENT DOCUMENTS 3,631,681 A * 1/1972 Taylor et al. ..... 405/299
4,227,833 A 10/1980 Plester et al.
5,062,033 A 10/1991 Kussel et al.
6,481,802 B1 * 11/2002 Kussel ..... 299/1.6

FOREIGN PATENT DOCUMENTS

| | | |
|---|---|---|
| DE | 42 02 246 A1 | 8/1992 |
| DE | 41 42 165 A1 | 4/1993 |
| DE | 195 46 427 A1 | 8/1996 |
| GB | 1 269 022 | 3/1972 |

OTHER PUBLICATIONS

Rabinovic, "Elements and Systems for Automatic Control of a Hydraulic Longwall Support," NEDRA Publishing, Moscow, 1977, pp. 167-189.

* cited by examiner

*Primary Examiner*—John Kreck
(74) *Attorney, Agent, or Firm*—Alston & Bird LLP

(57) ABSTRACT

A longwall support in a mine that comprises a plurality of longwall support units. The longwall support units are supported relative to a conveyor by stays that comprise cylinder-piston units. A control system with data acquisition, data storage, and programming is used to adapt the distribution of the staying forces over the length of the longwall, the sum of the staying forces acting upon the length of the longwall (total staying force), and the distribution of the advance forces over the length of the longwall continuously to the desired position of the conveyor. As a result, it is possible to influence the total staying force by the number of the stays with respect to an adjustable maximum, or the total staying force by controlling the longitudinal forces of the individual stays, or the total staying force as a function of at least one of the end positions of the conveyor.

9 Claims, 3 Drawing Sheets

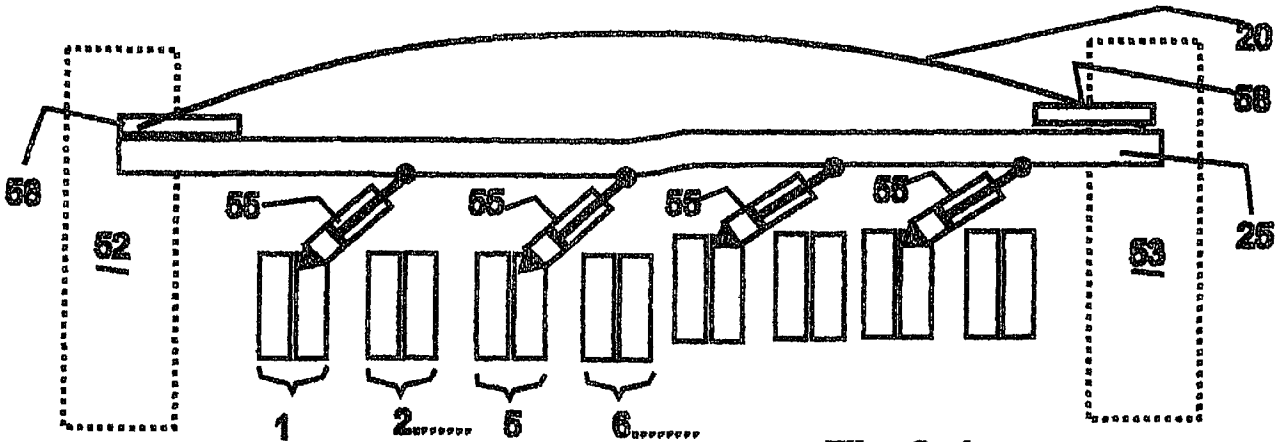
Fig.3.1
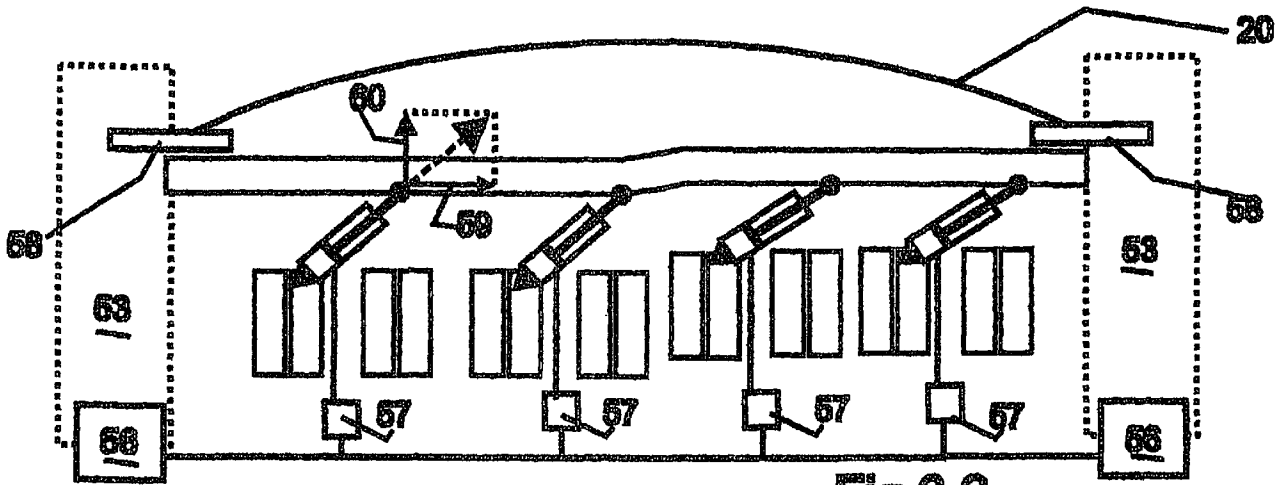
Fig.3.2

COAL FACE SUPPORT IN A MINE

BACKGROUND

Longwall supports are disclosed, for example, in DE 42 02 246 A1. A longwall support of this type consists of a coal cutting machine or plow, which is driven by a cable, a conveyor, and longwall support units. The conveyor extends in front of the working face and includes a channel, in which an armored conveyor moves along the working face. The channel is divided into individual units. While these units are interconnected, they are able to perform a movement relative to one another in the working direction. Each of these units connects by means of a cylinder-piston unit (advance cylinder) to a longwall support unit. Each longwall support unit serves the purpose of propping the mined longwall. Each longwall support unit is mounted on runners and comprises a roof construction, which is stayed relative to the runners by cylinder-piston units, and serves to support a hanging roof.

In addition, stays are provided, which exert on the conveyor a force that is inclined in the conveying direction. These stays are typically cylinder-piston units, which are each supported on the one hand on a longwall support unit and on the other hand on the channel unit that faces an adjacent longwall support unit. As a result, these stays exert one force component that is directed against the working face, which is called advance force in the present application, and another force component in the conveying direction, which is called staying force in the present application.

The use of the stays permits compensating longitudinal forces that act upon the channel/conveyor. These are not only forces that result from the conveyance, but also weight forces, which result from the fact that the working face and, with that, also the conveying plane are inclined over the entire length of the longwall or also only over a part of the length. To compensate the forces, one may provide, for example, every third, fourth, tenth longwall support unit with such a stay, which is preferably stayed in facing relationship with the next, directly adjoining longwall support unit.

The number of the stays and the pressure adjusted therein are typically determined by computation or estimation of the extent of the forces which are to be expected and to be compensated in the longitudinal direction of the conveyor.

It is therefore an object of the invention to minimize the stays with respect to their number and with respect to the pressure that is to be adjusted in them, to keep expenditure of the systems low with respect to investment and operation, and to integrate the stays into the longwall face operation such that the stays assume an important function in the mining and conveying of rock and/or coal.

BRIEF SUMMARY OF THE PRESENT INVENTION

The present invention addresses this problem by providing a longwall support in a mine comprising a plurality of longwall support units, which are placed side by side over the length of the longwall between passages, a mining machine that is adapted for movement along the longwall face, as well as a conveyor that extends over the length of the longwall between the mining machine and the longwall support units; a plurality of stays consisting of cylinder-piston units, which are each supported between an abutment on one of the longwall support units and a step bearing on the conveyor and pivoted such that each of the stays exerts by its longitudinal force a force component against the working face (advance force) and a force component in the direction of the longwall (staying force) for absorbing the forces that act upon the conveyor in the direction of the longwall, in particular downward forces of a hanging roof; and a control system with data acquisition, data storage, and programming, which continuously permits adapting at least one of the distribution of the staying forces over the length of the longwall, the sum of the staying forces that are active over the length of the longwall (total staying force), or the distribution of the advance forces over the length of the longwall to the desired position of the conveyor.

In the present invention, the stays for the longwall support are used not only statically, but also are dynamically incorporated in the mining operation.

For reasons of optimizing investment and maintenance costs, all efforts are to be made to limit the number of the stays to a required minimum. The invention makes it possible by determining the staying forces in the individual stays/cylinder piston units to determine also the total staying force and to rate it such that the position of the conveyor remains constant. This rating of the individual staying forces and the total staying force can occur on the one hand by adjusting the pressure, which biases the cylinder-piston units. On the other hand, however, it is also possible to limit the number of the stays such that the pressure available to the individual stays permits achieving the total staying force that is maximally required for stabilizing the position of the conveyor.

The number of the stays is to be determined and to be adapted to the available maximum pressure such that the individual staying forces can still be increased, if this is needed for influencing the position of the conveyor. A further development of the invention proposes to adjust the individual staying forces and, with that, also the total staying force as a function of at least one of the end positions of the conveyor. To this end, the end position of the conveyor is measured in the region of the main drive and/or the auxiliary drive, and the staying forces are controlled as a function of the measured value such that the end position remains substantially constant, and the conveyor does not excessively extend into the passage.

One may assume that in most cases the conveyor is not laid level, but that the channel forms relative to a horizontal or inclined plane elevations and valleys. Such unevennesses may also lead to a shifting of the one and/or the other end position of the conveyor. This is avoided by providing for adjustment of not only the total staying force, but also the distribution of the force components in the direction of advance (advance forces) by adjusting the forces of the stays. With that, it is accomplished that the rock is not mined in a level working face, but that unevennesses develop in the working face in the form of convex or concave bulges. These bulges suffice to compensate and equalize not only position changes of the conveyor, unevennesses of the position of the conveyor on the ground, and the end positions of the conveyor, but also the position of the conveyor in intermediate sections as well as the elongation and elongation distribution of the conveyor.

Mining conditions in the longwall are subjected to continuous changes. Naturally, one of the causes is the progressive mining and the support that follows the working face. As a consequence, also optimally adjusted force conditions on the conveyor are subjected to a continuous change, and—when viewed over the time—significant interference factors, for example, by the development of unevennesses in the working face and/or the position of the conveyor on the ground can make themselves noticeable.

With the further development of the invention according to claim 9 it is accomplished that the invention is also able to take into account such changing situations. In particular, the introduction of force, which is applied by the stays to the conveyors in the direction of advance and conveyance, is continuously adapted to the progressive mining and support, and in particular to the advance movement of the longwall support units.

BRIEF DESCRIPTION OF THE DRAWINGS

Reference will now be made to the accompanying drawings, wherein:

FIG. 3 is a schematic plan view of a longwall with a conveyor and longwall support units.

DETAILED DESCRIPTION OF THE INVENTION

Figure 1:
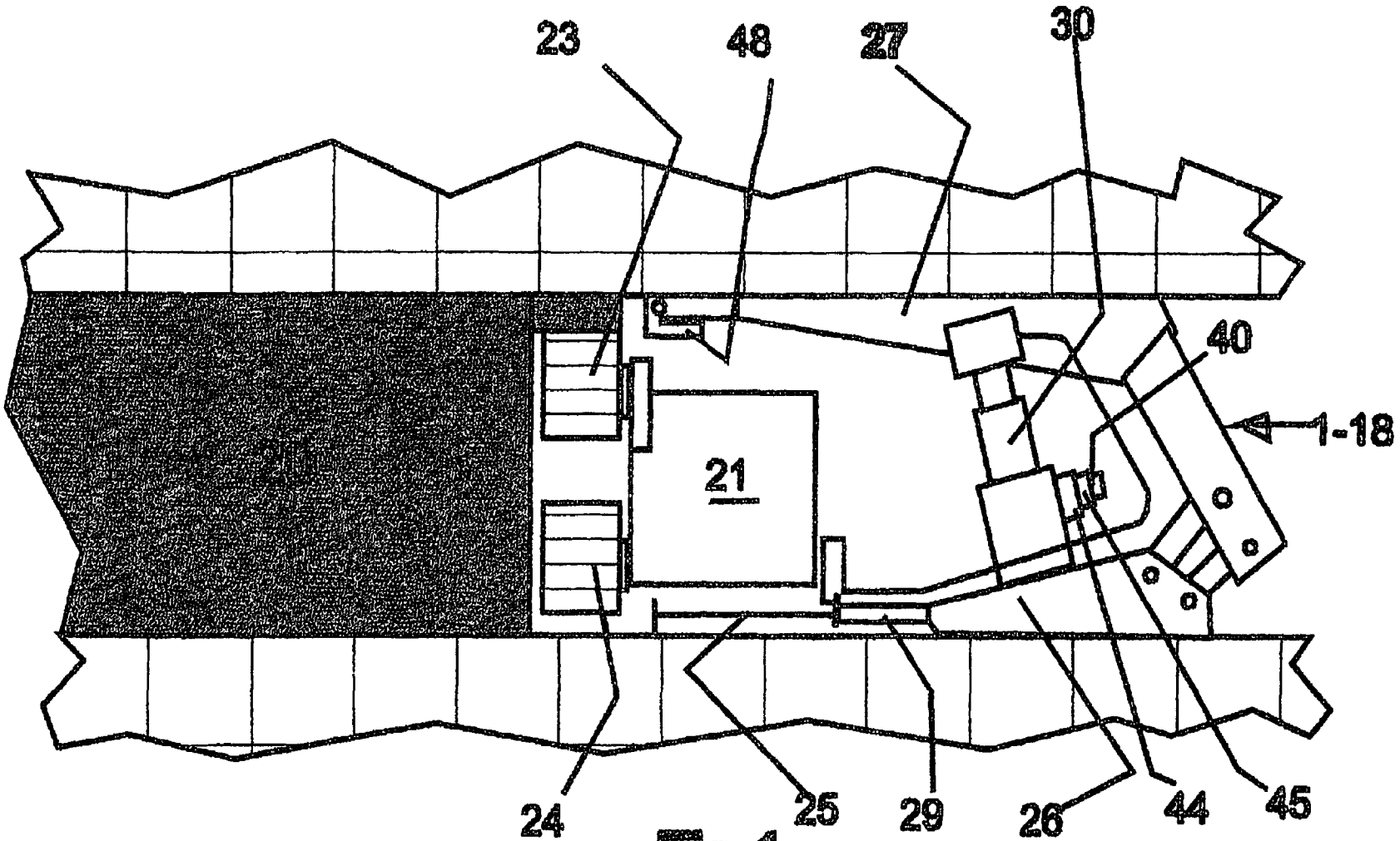
FIG. 1 is a sectional view of a longwall with a longwall support unit.
Figure 2:
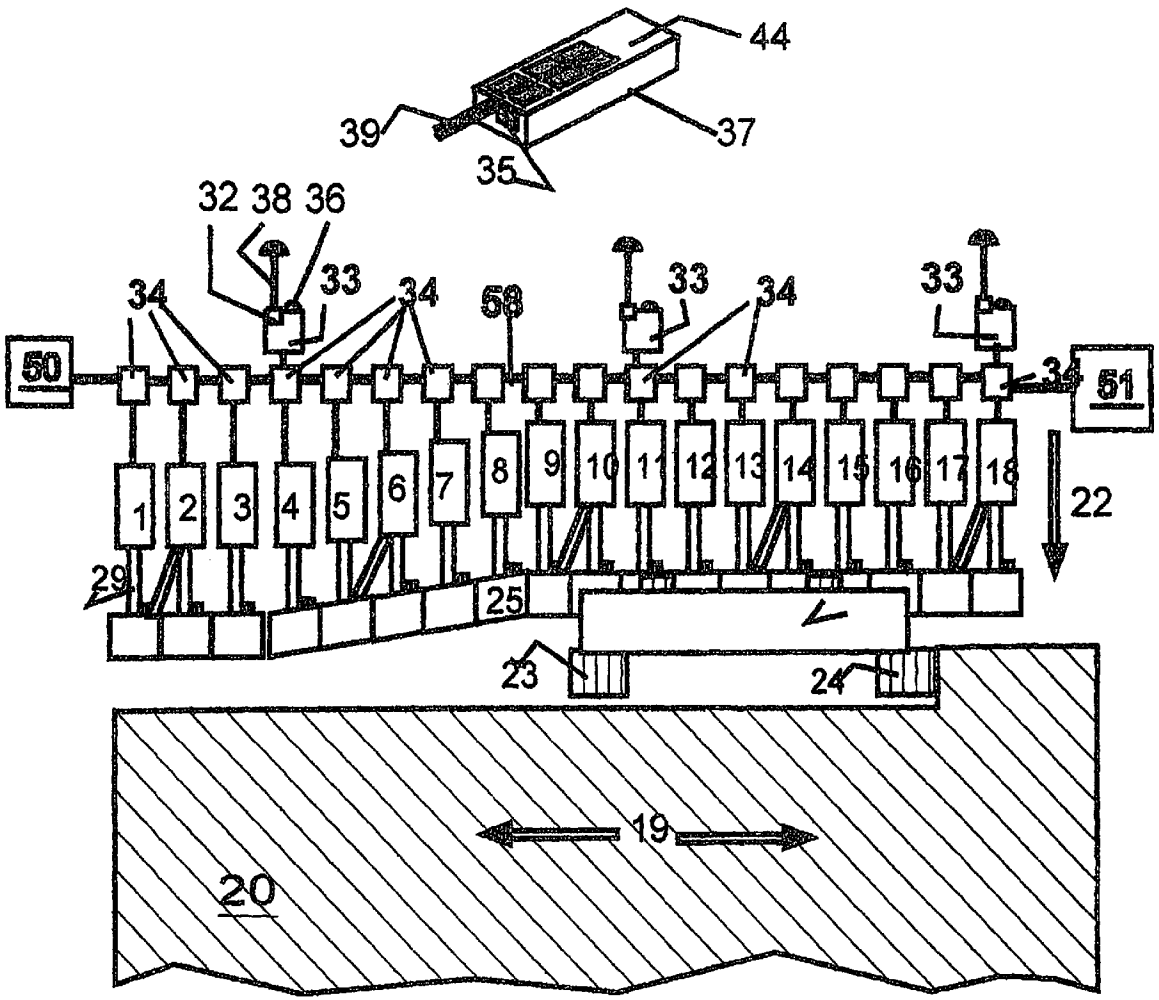
FIG. 2 is a schematic plan view of a coal cutting machine and a group of longwall support units.

FIG. 1 illustrates one of longwall support units 1-18. FIG. 2 illustrates a plurality of longwall support units 1-18. The support units are arranged along a coal bed 20. The coal bed 20 is mined in a working direction 22 with a cutting device 23, 24 of an extraction machine 21. In the illustrated embodiment, the extraction machine is a coal cutting machine 21.

The coal cutting machine 21 is movable in a cutting direction 19 by means of a cable not shown. It possesses two cutting rolls 23, 24 that are adjusted to different heights, and shear the coal face. The dislodged coal is loaded by the coal cutting machine, also named "cutter-loader," on a conveyor. The conveyor consists of a channel 25, in which an armored chain conveyor is moved along the coal face. The coal cutting machine 21 is adapted for moving along the coal face. The channel 25 is subdivided into individual units, which are interconnected, though, but are capable of performing a movement relative to one another in the working direction 22. Each of the units connects to one of the longwall support units 1-18 by means of a cylinder-piston unit (advance piston) 29, which is used a biasing means. Each of the longwall support units serves the purpose of supporting the longwall. To this end, a further cylinder-piston unit 30 is used, which stays a base plate relative to a roof plate. At its front end facing the coal bed, the roof plate mounts a so-called coal face catcher 48. This catcher is a flap that can be lowered in front of the mined coal face. The coal face catcher must be raised ahead of the approaching coal cutting machine 21. Likewise to this end, a further cylinder-piston unit not shown is used. These operating elements of the individual longwall support are shown only by way of example. While additional operating elements are present, they need not be mentioned and described for the understanding of the invention.

As aforesaid, each of the biasing means is a hydraulic cylinder-piston unit.

These cylinder-piston units are actuated via valves 44 and pilot valves 45. The pilot valve mounts a valve control device 40, i.e., a housing that accommodates the valve control.

In FIG. 2, the coal cutting machine moves to the right. For this reason, it is necessary that the coal face catcher of the longwall support unit 17 be folded back. On the other hand, the unit of channel 25 on the longwall support unit 9, which is located—in the direction of movement 19—behind the coal cutting machine 21, is advanced in the direction toward the mined coal face. Likewise, the following longwall support units 8, 7, 6, 5, and 4 are in the process of advancing in the direction toward the longwall or the mined coal face. The coal face catcher on these longwall support units has already been lowered again. The support units 3, 2, 1 have finished their approach and remain in this position, until the coal cutting machine approaches again from the right. As a function of the movements and the instantaneous position of the coal cutting machine, the control of these movements occurs in part automatically, in part by hand. To this end, a separate mining shield control device 34 is associated to each of the longwall supports 1-18. A separate longwall control device 33 is associated to a group of longwall support units or mining shield control devices. Each of the mining shield control devices 34 is associated to one of the longwall supports 1-18 and separately connected to the pilot valves 45 and main valves 44 of all biasing means of the longwall support units 1-18 via a valve control device (microprocessor) 40.

Each of the mining shield control devices serves as a central longwall support control. However, a group of a plurality of mining shield control devices can be superposed by a longwall control device 33, or also the entirety of the mining shield control devices can be superposed by a central longwall support control system (primary central control system 50 and/or secondary central control system 51) that connects to the mining shield control devices. Such an arrangement is shown in FIG. 2.

The central longwall support control system consists of the primary central control system 50 and secondary central control system 51. The control systems include data acquisition, data storage, and programming.

A cable 58 (bus line) interconnects all mining shield control devices 34. Each of the mining shield control devices retransmits operating commands for the longwall support. The operating command triggers in a certain mining shield a certain operating function, for example, in the sense of robbing, advancing, and setting. This mining shield operating command is received and retransmitted by all mining shield control devices 34 via the bus line 58. All operating commands of one of the longwall control devices are directly transmitted to the mining shield control device 34 that directly connects to the longwall control device. From this mining shield control device, the operating commands then reach all other mining shield control device 34 via the bus line 58. However, by a predetermined coding, only one of the longwall support units 1-18 or a group thereof is activated for carrying out the respective shield functions. The activated mining shield control device then converts the received operating command into valve control commands to the control valves or main valves that are associated to the particular mining shields.

The automatic release of the functions and operating sequences is disclosed, for example, in DE-A1 195 46 427.3.

For a centralized manual operation of the command input the control device 37 is used, which is constructed as a manually operated device, and is carried along by the operator. For inputting a command, the operator can be outside of the longwall, or at least be removed from the instant working location.

As aforesaid, the mining shield control devices 34 are interconnected by means of the cable 58, which has in the designs of the art only two conductors, and serves for serially transmitting respectively a code word and the mining shield operating command. Only that of the mining shield control devices 34 (longwall support units) is addressed, whose stored code word is identical with the transmitted code word. Thus, the cable 58 is a two-conductor cable, which extends in the form of a bus line from one mining shield control device 34 to the next, and also interconnects the primary central control system 50 and the secondary central control system 51 via the intermediate mining shield control devices 34.

FIG. 3 also illustrates stays 55. The stays 55 are cylinder-piston units, which each extend between runners 54 of (for example) longwall support unit 1 and the channel 25 opposite to the adjacent (in this case) longwall support unit 2. The next stay 55 can then extend, for example, between the runners 54 of the longwall support unit 5 and the channel facing the adjacent longwall support unit 6. The stays need not necessarily be arranged in even distribution along the passage. The number and the distribution of the stays depend on the longitudinal forces that are active in the direction of the longwall. The fact that in accordance with the invention stay data—in particular the pressures in the cylinder as well as the staying angle relative to the direction of conveyance—are continuously acquired, makes it possible to achieve besides optimal operating conditions also an optimal layout with respect to number and size of the stays.

For reasons of space, FIG. 3.2 only indicates that the stays are controlled by a control unit 56. The control unit 56 connects to individual control devices 57, which are each used to control and measure the pressure, and insofar also permit a feedback to the control unit 56. In the region of passages 52, 53, measuring devices 58 are provided. The measuring devices 58 determine the end position of the conveyor 25. The measuring signal of the two measuring devices 58 is returned to the control unit 56. With that, it is accomplished that the conveyor and the conveyor channel are aligned in the center between the passages and do not project into the one or the other passage. When the measuring devices find that the conveyor drifts in one direction, the staying forces are increased or decreased such that the conveyor is again stabilized or returned to its position.

As best seen in FIGS. 3.1 and 3.2, because of their oblique position relative to the conveying direction, the stays exert a force component 59 in the conveying direction and a further force component 60 in the direction of advance. The number of stays is determined such that they permit absorbing the longitudinal forces that act upon the channel 25. In this connection, it should be noted that such longitudinal forces are not necessarily constant over the entire length of the longwall. Rather, they can vary and lead in this case to a staying of the channel. The invention makes it possible to determine not only the staying forces and the sum of the force components 59 in the conveying direction, but also the distribution of these force components 59, and accordingly to effect compensation by controlling the pressure.

The invention furthermore makes it possible to take into account the change of the force component 60, which occurs during an advance movement of the channel or longwall support unit by changing the angle phi (between the piston axis and the conveying direction).

Furthermore, it becomes possible to determine the end position of the conveyor via the measuring devices 58, and to control the staying forces as a function of the desired end position, which is shown in FIG. 3.2, by influencing the pressure in the individual stays such that the channel and the conveyor 25 do not project into the passages 52, 53.

Furthermore, the invention avoids that an excessive number of stays is used. Rather, the number is to be determined such that it permits applying in any event the required staying forces for a substantially constant position of the conveyor channel 25 with the available maximum pressures. This is assisted by the fact that the individual control devices 57 permit measuring the pressures and pressure distributions constantly, and adjusting both the layout of the entire arrangement and its operation to requirements.

Finally, the invention also permits influencing the advance forces in the direction of the force component 60. For example, when the measuring device finds that the conveyor is too long in its extension and projects on both sides into the passages 52, 53, the staying forces and advance forces respectively are increased and distributed over the length of the longwall such that the coal face 20 is worked with a greater bulge—note FIG. 3.2—instead of a weaker bulge, which shortens the layout of the conveyor. In the same way, it is possible to compensate local staying of the conveyor, in that in the particular local range, the bulge of the coal face is also varied, so that the conveyor locally extends over a greater or shorter length. To achieve a greater bulge of the coal face in a local region, the distribution of the pressures in the stays is varied accordingly.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A longwall support in a mine comprising:

a plurality of longwall support units, which are placed side by side over the length of the longwall between passages, a mining machine that is adapted for movement along the longwall face, as well as a conveyor that extends over the length of the longwall between the mining machine and the longwall support units;

a plurality of stays consisting of cylinder-piston units, which are each supported between an abutment on one of the longwall support units and a step bearing on the conveyor and pivoted such that each of the stays exerts by its longitudinal force a force component against the working face (advance force) and a force component in the direction of the longwall (staying force) for absorbing the forces that act upon the conveyor in the direction of the longwall, in particular downward forces of a hanging roof; and a control system with data acquisition, data storage, and programming, which continuously permits adapting at least one of the distribution of the staying forces over the length of the longwall, the sum of the staying forces that are active over the length of the longwall (total staying force), or the distribution of the advance forces over the length of the longwall to a desired position of the conveyor.

2. The longwall support of claim 1, wherein the total staying force is influenced by the number of the stays with respect to an adjustable maximum.

3. The longwall support of claim 1, wherein the control system is structured to measure the longitudinal force in the stays and determine an angular position of a respective stay relative to the direction of the longwall, to determine an angular position of the individual stays relative to the direction of the longwall, and through corresponding data acquisition and data storage, to determine actually prevailing staying forces as well as their distribution over the length of the longwall or the actually prevailing advance forces and their distribution over the length of the longwall, and to adapt them to the position of the conveyor.

4. The longwall support of claim 1, wherein the total staying force is influenced by controlling the longitudinal forces of the individual stays.

5. The longwall support of claim 1, wherein the total staying force is influenced as a function of at least one end position of the conveyor.

6. The longwall support of claim 1, wherein the distribution of the advance forces is influenced as a function of at least one end position of the conveyor.

7. The longwall support of claim 1, wherein the distribution of the advance forces is a function of an unevennesses of the position of the conveyor on the ground.

8. The longwall support of claim 1, wherein the distribution of the advance forces is a function of necessary position corrections of the conveyor.

9. The longwall support of claim 1, wherein the distribution of the advance forces is adapted to an elongation or an elongation distribution of the conveyor.

* * * * *